US008186859B2

(12) United States Patent
Shih

(10) Patent No.: US 8,186,859 B2
(45) Date of Patent: May 29, 2012

(54) CLIP WITH LIGHT

(76) Inventor: Leo Shih, Taichung (TW)

( * ) Notice: Subject to any disclaimer, the term of this patent is extended or adjusted under 35 U.S.C. 154(b) by 356 days.

(21) Appl. No.: 12/635,051

(22) Filed: Dec. 10, 2009

(65) Prior Publication Data

US 2011/0140639 A1 Jun. 16, 2011

(51) Int. Cl.
*F21V 17/06* (2006.01)
*B25B 9/02* (2006.01)

(52) U.S. Cl. ..... 362/438; 362/119; 362/157; 362/191; 362/208; 294/99.1; 294/99.2; 315/362

(58) Field of Classification Search ..... 362/114, 362/116, 118, 119, 157–208, 438; 294/99.1, 294/99.2; 315/362
See application file for complete search history.

(56) References Cited

U.S. PATENT DOCUMENTS 4,215,531 A * 8/1980 Wong ..... 368/10
4,883,397 A * 11/1989 Dubost ..... 411/174
5,647,623 A * 7/1997 Shiao ..... 294/65.5
6,478,442 B2 * 11/2002 Chen ..... 362/119
6,623,136 B1 * 9/2003 Kuo ..... 362/118
6,702,499 B1 * 3/2004 Fang ..... 401/243
6,893,143 B2 * 5/2005 Opolka ..... 362/241
7,531,197 B2 * 5/2009 Jones ..... 426/104
7,954,870 B2 * 6/2011 Chen ..... 294/99.2
8,096,305 B1 * 1/2012 Cheney ..... 132/73.5
2006/0180169 A1 * 8/2006 Lund et al. ..... 132/73.5
2009/0267372 A1 * 10/2009 Chen ..... 294/99.2
2010/0073918 A1 * 3/2010 Shaljian ..... 362/120
2010/0295326 A1 * 11/2010 Chen ..... 294/99.2

* cited by examiner

*Primary Examiner* — Douglas W Owens
*Assistant Examiner* — Thai Pham

(57) ABSTRACT

A clip with a light comprises a body including a first and a second clip members to be flexibly pressed, and an illuminating device disposed between the first and second clip members and having a receiving cylinder, a light received in the receiving cylinder and provided with a first and a second connecting legs, a cell set received in the receiving cylinder to supply power to the light, a power circuit mounted in the receiving cylinder and provided with an electrode of a rear end of the cell set electrically connected to the first connecting leg of the light and the second connecting leg electrically coupled to an electrode of a front end of the cell set, an actuating member series connected onto the power circuit and having pressing blocks extending out of the receiving cylinder to press and release the first and second clip members, controlling the actuating member.

19 Claims, 17 Drawing Sheets

CLIP WITH LIGHT

BACKGROUND OF THE INVENTION

1. Field of the Invention

The present invention relates to a clip with a light to clip an object and obtain a power saving purpose.

2. Description of the Prior

A convention precise clip is used to clip a tiny and precise object. Referring to FIGS. 1 and 2, a clip 10 includes a first and a second clip members 11, 12, and the first and the second clip members 11, 12 include a first and a second clipping portions 111, 121 disposed on front ends thereof respectively, and rear ends of the first and the second clip members 11, 12 being connected with each other. The first and the second clip members 11, 12 are flexibly pressed to clip an object, however, such a conventional clip can not make illumination in a dim environment to clip the object precisely.

To improve such a defect, an improved clip with a light has been developed. As shown in FIGS. 3 and 4, an improved clip with a light includes a body 20 having a seat 21 disposed on a rear end thereof, and the seat 21 includes a first and a second clip members 22, 23 mounted on two sides thereof respectively to be pressed, the first and the second clip members 22, 23 include a first and a second grip segments 221, 231 formed on middle portions thereof individually to be held by user, and include a first and a second clipping portions 222, 223 arranged on front ends thereof respectively to clip the object. The seat 21 of the body 20 includes an illuminating device 30 installed on a bottom surface thereof, and the illuminating device 30 includes a receiving cylinder 31 and a LED light 32 received in the receiving cylinder 31, the receiving cylinder 31 includes a button 33 fixed thereon to turn on and off the light 32. In operation, the button 33 is pressed to turn on the illuminating device 30 to make light, clipping the object. Nevertheless, such improved clip with the light still has the following disadvantages:

1. When the user operates the clip, the button 33 is pressed to turn on the illuminating device 30 to make lights, operating inconveniently.

2. After the button 33 is pressed, the light 32 remains in an illuminating state, therefore the button 33 has to be released after finishing clipping operation, having inconvenient operation.

3. After the button 33 is pressed to turn on the light 32, if the user is desired to stop clipping the object, the light 32 remains in an illuminating status, thereby consuming cells. Besides, the button 33 has to be pressed again to illuminate the light as required.

The present invention has arisen to mitigate and/or obviate the afore-described disadvantages.

SUMMARY OF THE INVENTION

The primary object of the present invention is to provide a clip with a light that is capable of turning on and off the illuminating device automatically based on demands.

A further object of the present invention is to provide a clip with a light that when the switch is switched to a first position, the switch is in a circuit conducting status, and the first and the second clip members are pressed or released to turn on and off the illuminating device automatically, and when the switch is switched to a second position, the switch is in a circuit breaking state so that the power circuit is broken to turn off the illuminating device, thus operating the clip without illumination based on requirement.

Another object of the present invention is to provide a clip with a light that the receiving cylinder is additionally provided with another power circuit series connected a switch, and when the switch is switched to a first position, the switch is conducted so that the power circuit is conducted to keep illuminating the light based on requirement, and when the switch is switch to a second position, the switch is in a circuit breaking state so that the first and the second clip members are pressed and released to turn on and off the illuminating device based on demands.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
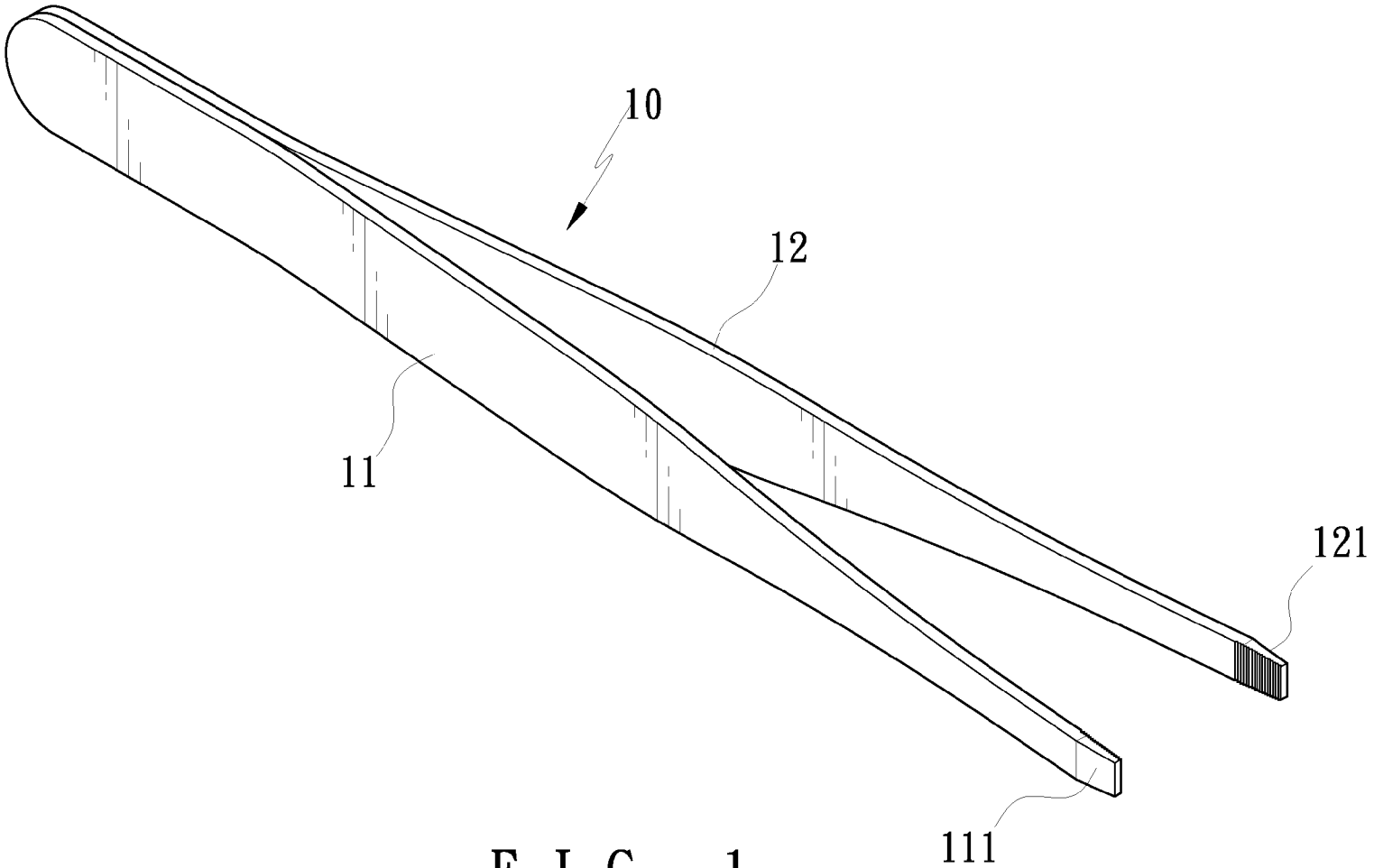
FIG. 1 PRIOR ART
FIG. 1 is a perspective view a conventional clip.
Figure 2:
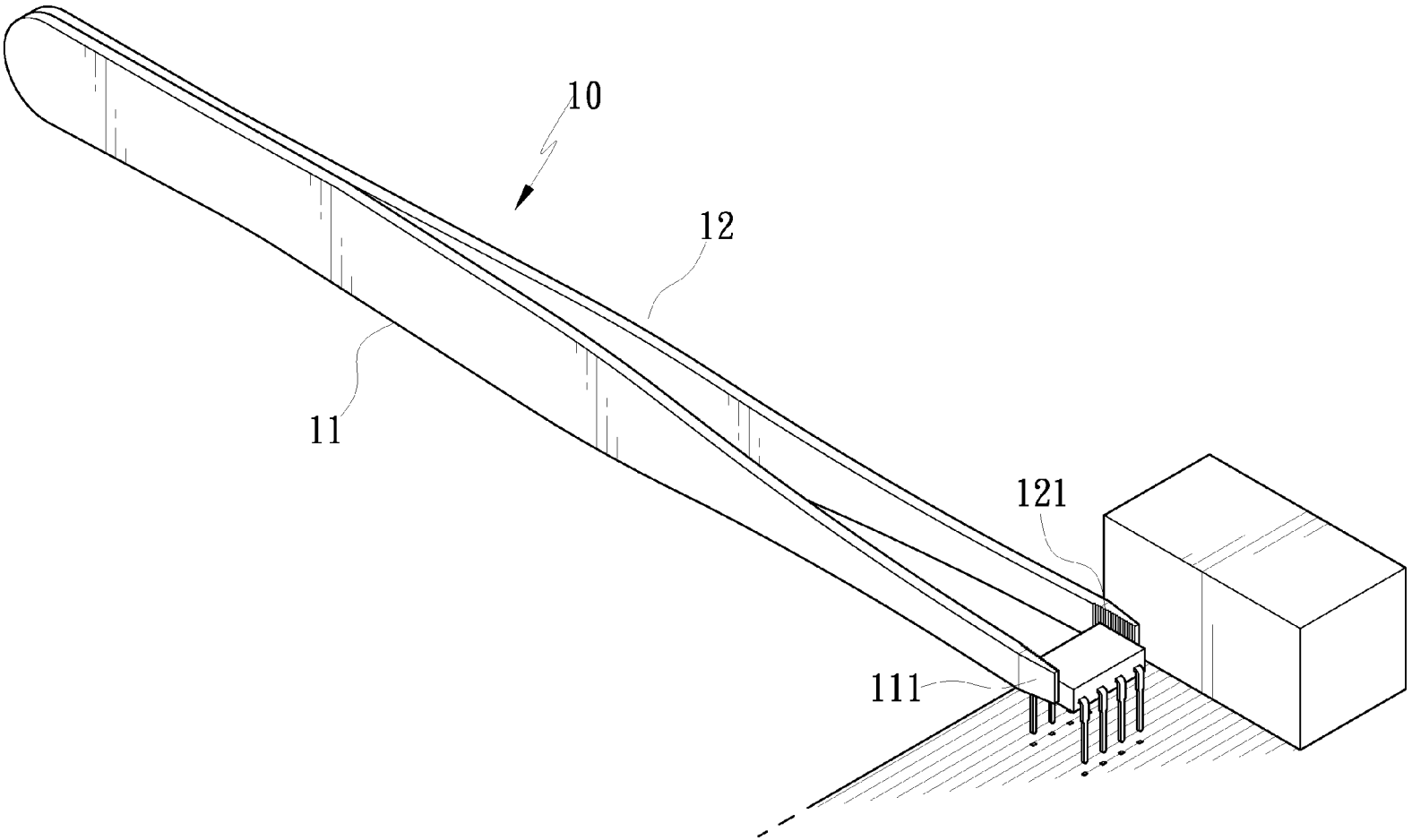
FIG. 2 PRIOR ART
FIG. 2 is a perspective view showing the operation of the conventional clip.
Figure 3:
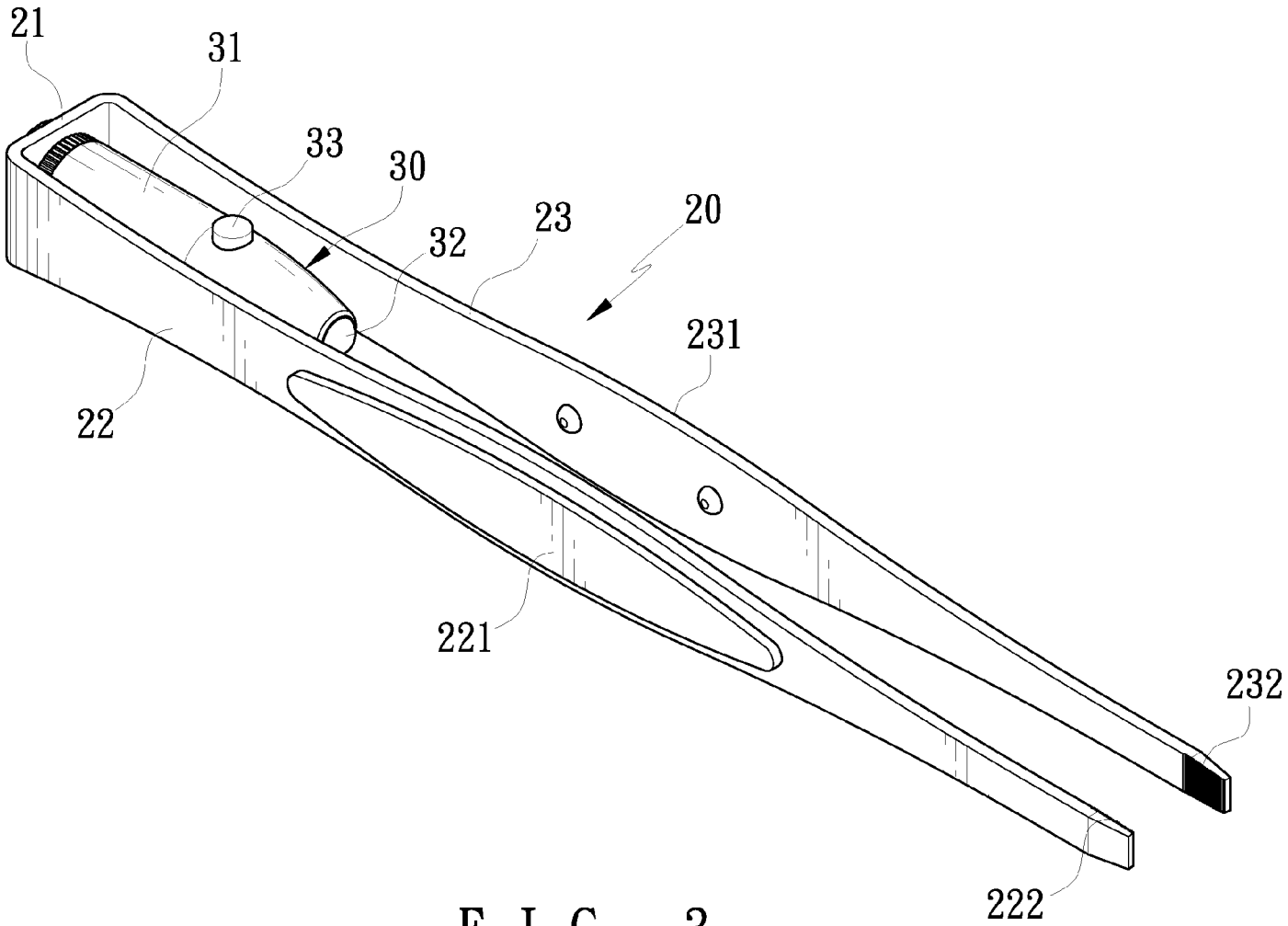
FIG. 3 PRIOR ART
FIG. 3 is a perspective view of a conventional clip with a light.
Figure 4:
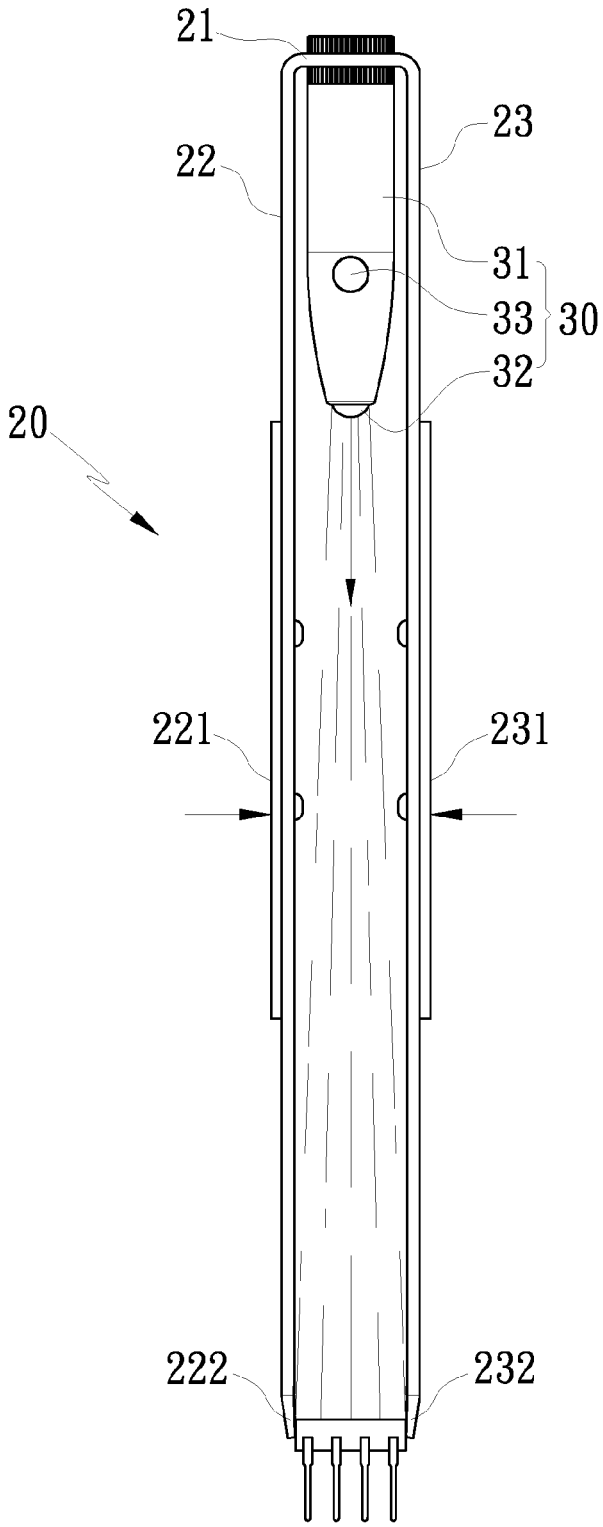
F I G . 4 PRIOR ART
FIG. 4 is a cross sectional view showing the operation of the conventional clip with the light.
Figure 5:
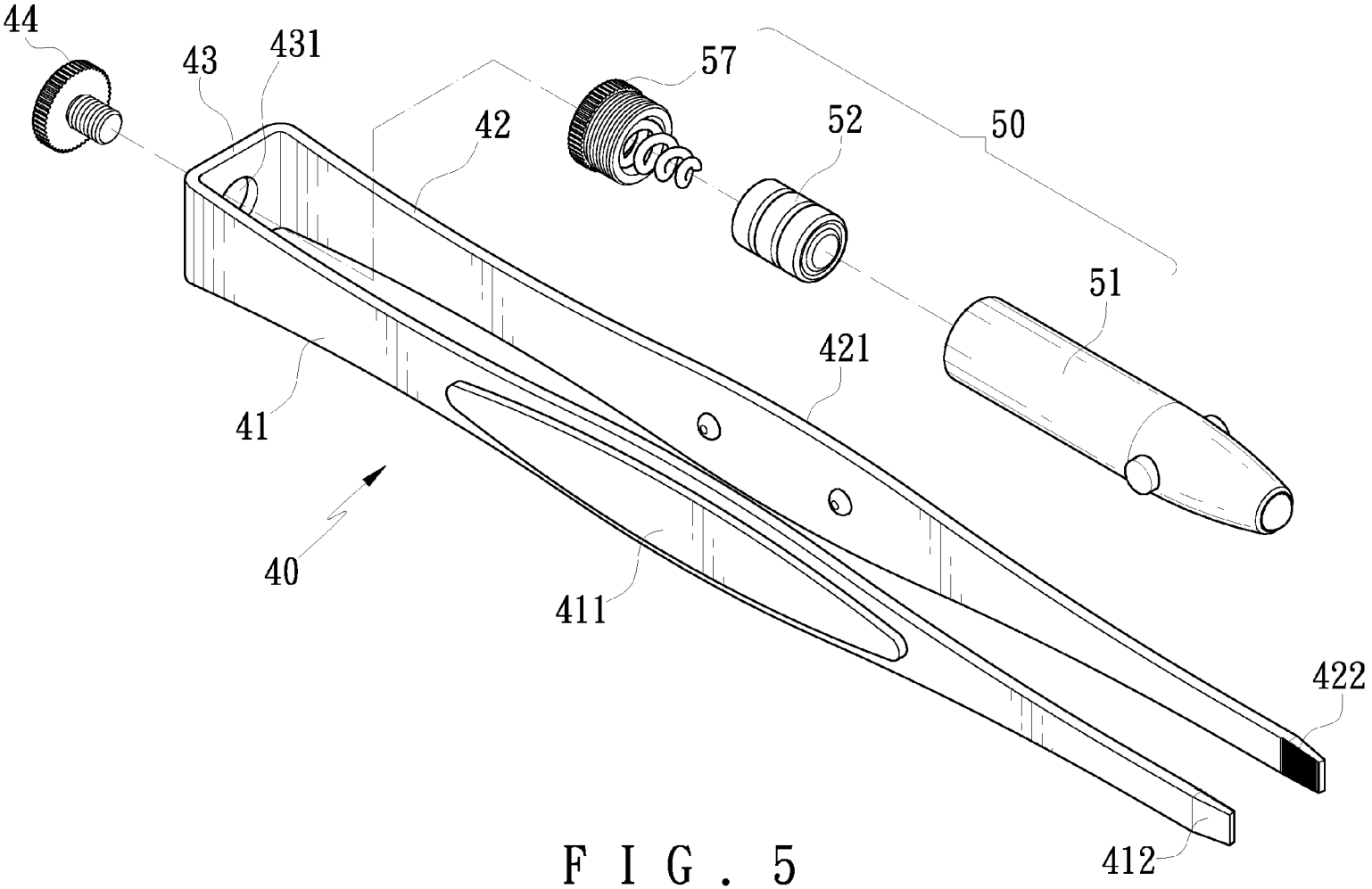
FIG. 5 is a perspective view showing the exploded components of a clip with a light according to a first embodiment of the present invention.
Figure 6:
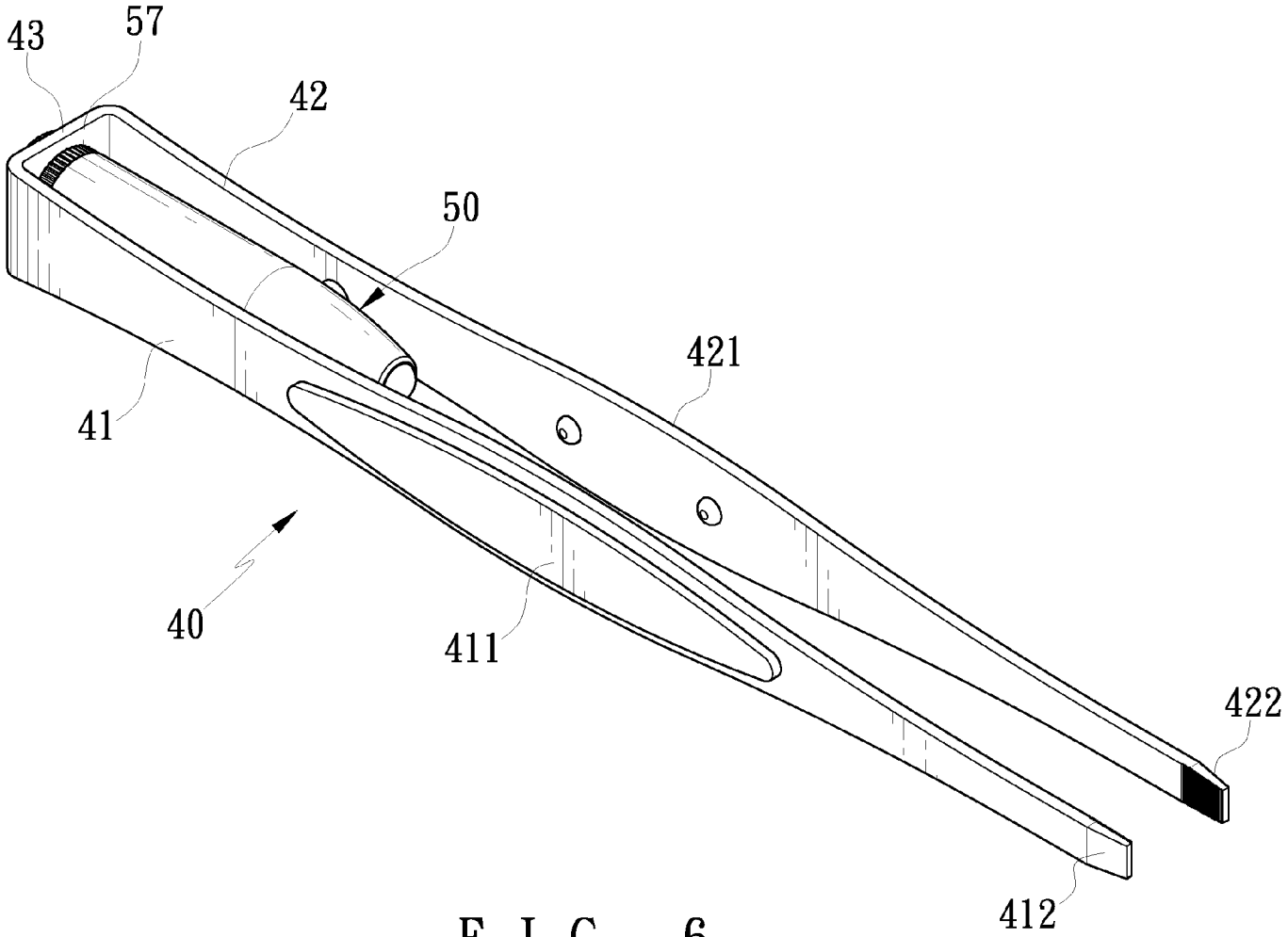
FIG. 6 is a perspective view showing the assembly of the clip with the light according to the first embodiment of the present invention.

Referring to FIGS. 5 and 6, a clip with a light according to a first embodiment of the present invention comprises a body 40 and an illuminating device 50, the body 40 including a flexible first clip member 41 and a second clip member 42, and between rear ends of the first and the second clip members 41, 42 being disposed a seat 43, and the first and the second clip member 41, 42 including a first and a second grip segments 411, 421 mounted on middle portions thereof respectively to be held by a user, and including a first and a second clipping portions 412, 422 fixed on front ends thereof individually and formed in a point, curve, or straight shape. In this embodiment, the first and the second clipping portions 412, 422 are straight and include sawtooth surfaces arranged thereon individually. Furthermore, the body 40 includes the illuminating device 50 secured thereon. In this embodiment, the illuminating device 50 is arranged on an inner side of the seat 43 of the body 40, and the seat 43 includes a hole 431 disposed thereon to insert a screwing element 44 with threads 441 so that the illuminating device 50 is screwed with the screwing element 44 to be positioned between the first and the second clipping members 41, 42.

Figure 7:
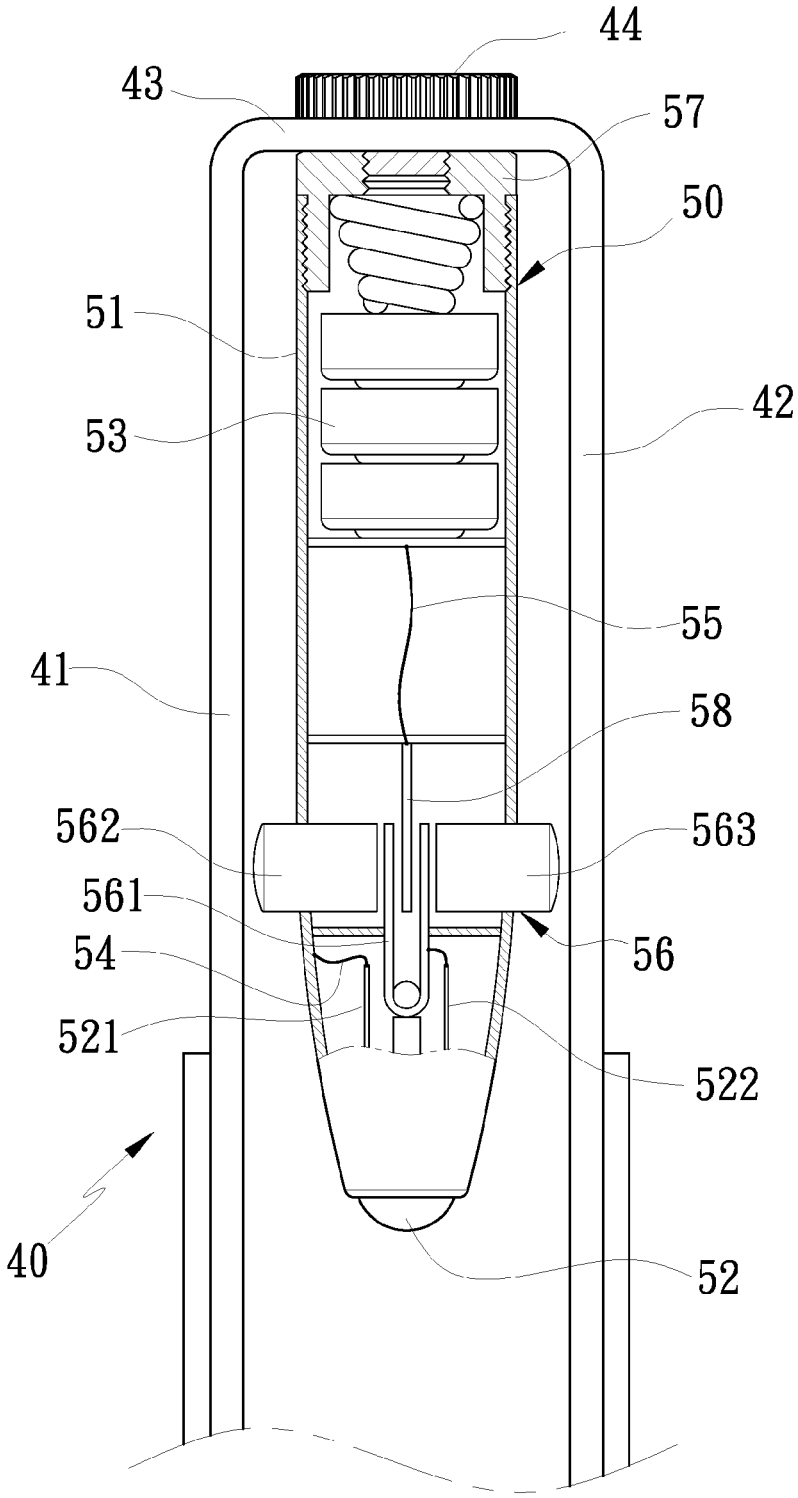
FIG. 7 is a cross sectional view showing a part of the clip with the light according to the first embodiment of the present invention.

Referring to FIG. 7, the illuminating device 50 includes the receiving cylinder 51, a light 52 received in the receiving cylinder 51, a cell set 53 to supply power to the light 52, a first power circuit 54, a second power circuit 55, a flexible actuating member 56, and a cover 57, wherein a rear end of the cover 57 is screwed with the screwing element 44 so that the illuminating device 50 is screwed to the seat 43, and a front end of the cover 57 is screwed with the receiving cylinder 51 to abut against an electrode of a rear end of the cell set 53, the first power circuit 54 includes an electrode of the rear end of the cell set 53 electrically connected to a first connecting leg 521 of the light 52. In this embodiment, the first power circuit 54 includes the electrode of the rear end of the cell set 53 electrically connected to the cover 57 and is conducted to an inner wall of the receiving cylinder 51, and then is electrically connected to the first connecting leg 521 of the light 52. The second power circuit 55 includes a second connecting leg 522 of the light 52 electrically coupled to an electrode of the rear end of the cell set 53 so as to form an electrical circuit with the first power circuit 54, wherein the first power circuit 54 or the second power circuit 55 includes a flexible actuating member 56 series connected thereon. In this embodiment, the actuating member 56 is series connected to the second power circuit 55, and the actuating member 56 includes an electrically conductive U-shaped resilient piece 561 to flexibly expand and retract, and the resilient piece 561 includes pressing blocks 562, 563 disposed on two outer sides thereof to extend out of the receiving cylinder 51 and correspond to the first and the second clip members 41, 42 respectively, and the receiving cylinder 51 includes an electricity conducting member 58 mounted therein in response to an inner wall of the resilient piece 561, and one end of the second power circuit 55 is in connection with the electricity conducting member 58, another end of the second power circuit 55 couples with the resilient piece 561 so that the actuating member 56 controls the light 52 to turn on and off.

Figure 8:
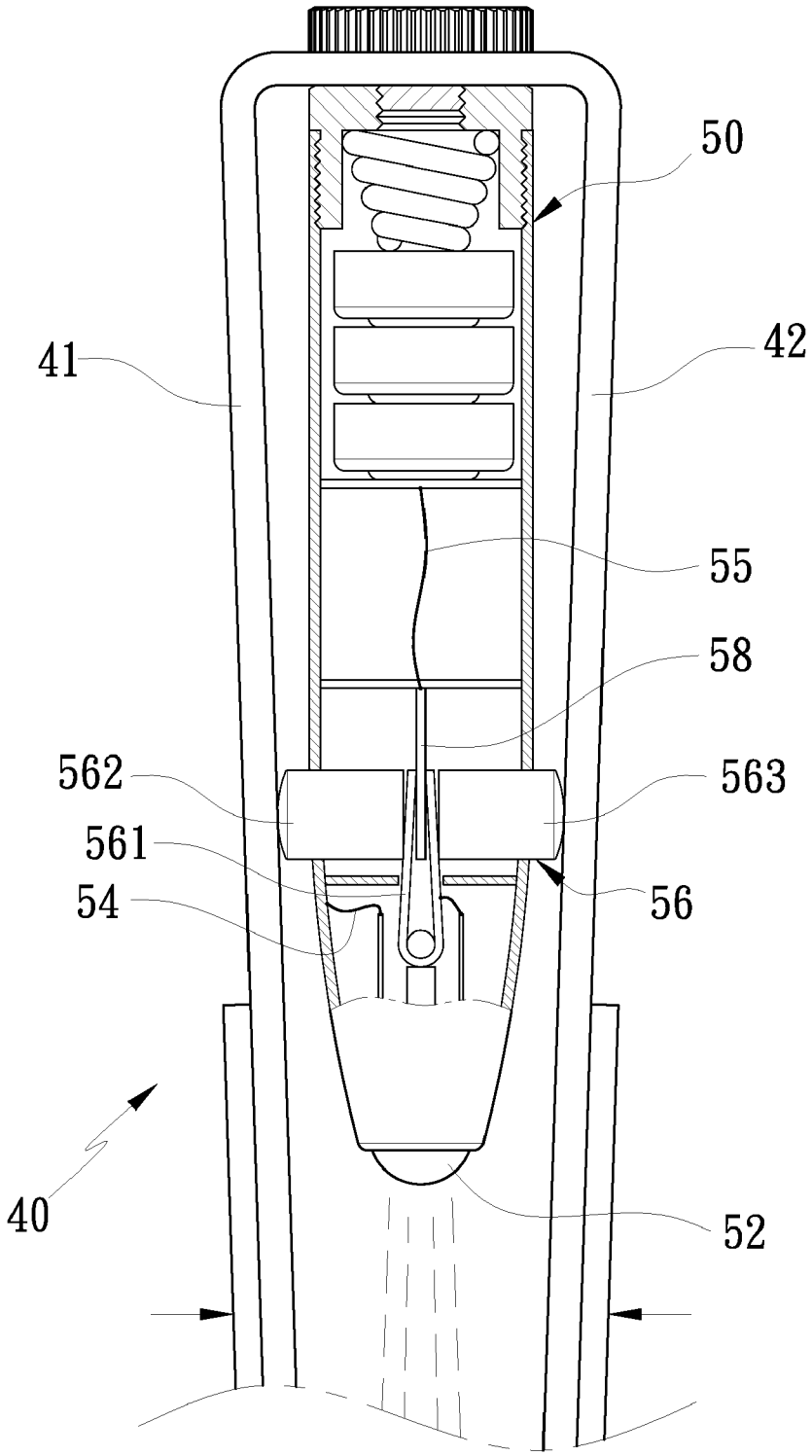
FIG. 8 is a cross sectional view showing the operation of the clip with the light according to the first embodiment of the present invention.

As shown in FIG. 8, when the user presses the first and the second clip members 41, 42 to clip an object, the first and the second clip member 41, 42 press the pressing blocks 562, 563 of the actuating member 56 to move inward so that the resilient piece 561 contacts with the electricity conducting member 58, hence the first and the second power circuits 54, 55 generate a conduced circuit to turn on the light 52, making an illumination.

Figure 9:
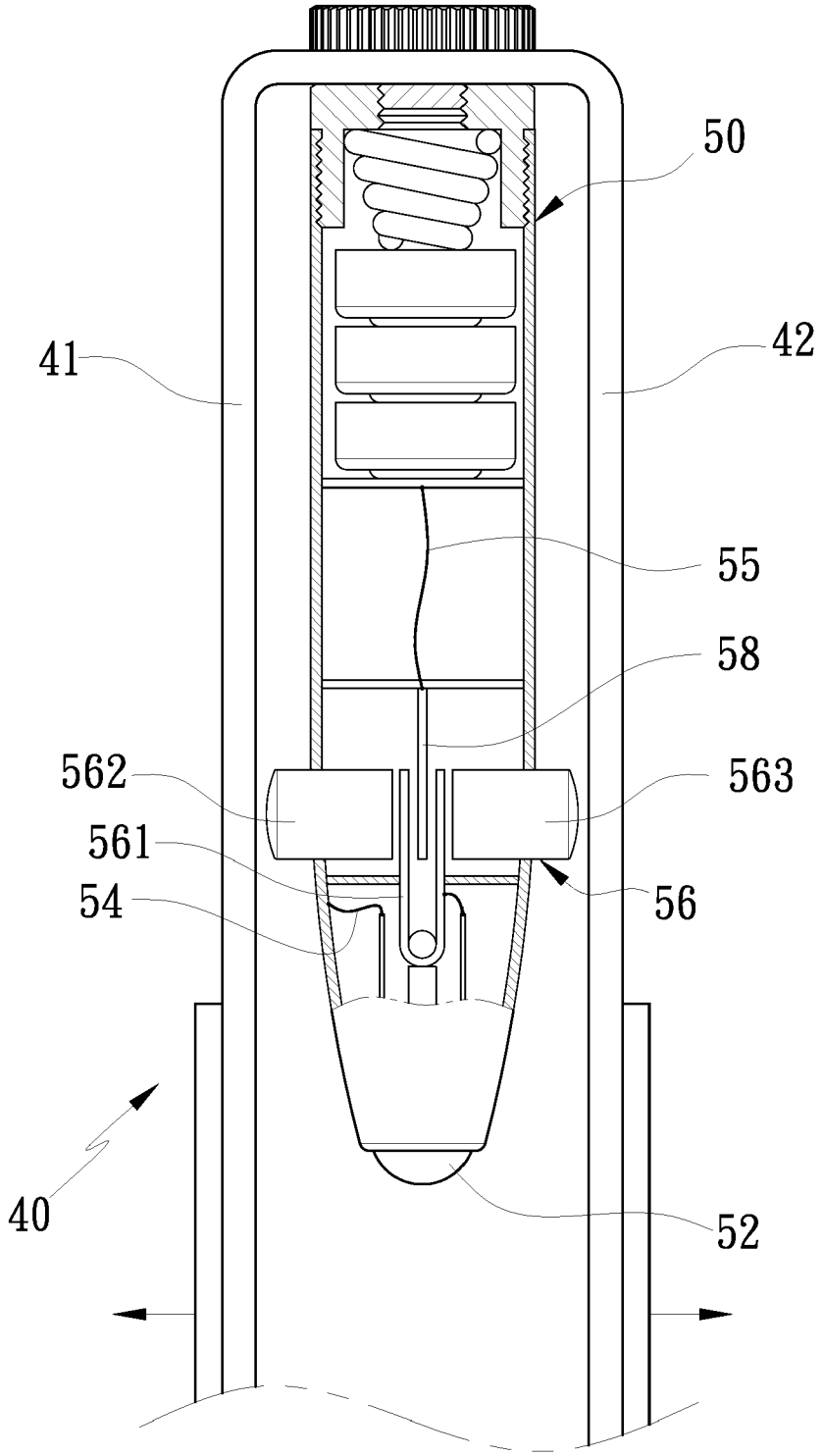
FIG. 9 is another cross sectional view showing the operation of the clip with the light according to the first embodiment of the present invention.

Referring to FIG. 9, when the user releases the first and the second clip members 41, 42, the first and the second clip members 41, 42 remove from the pressing blocks 562, 563 of the actuating member 56 so that the resilient piece 561 does not contact with the electricity conducting member 58 and the second power circuit 55 generates a circuit break to turn off the light 52 automatically.

Figure 10:
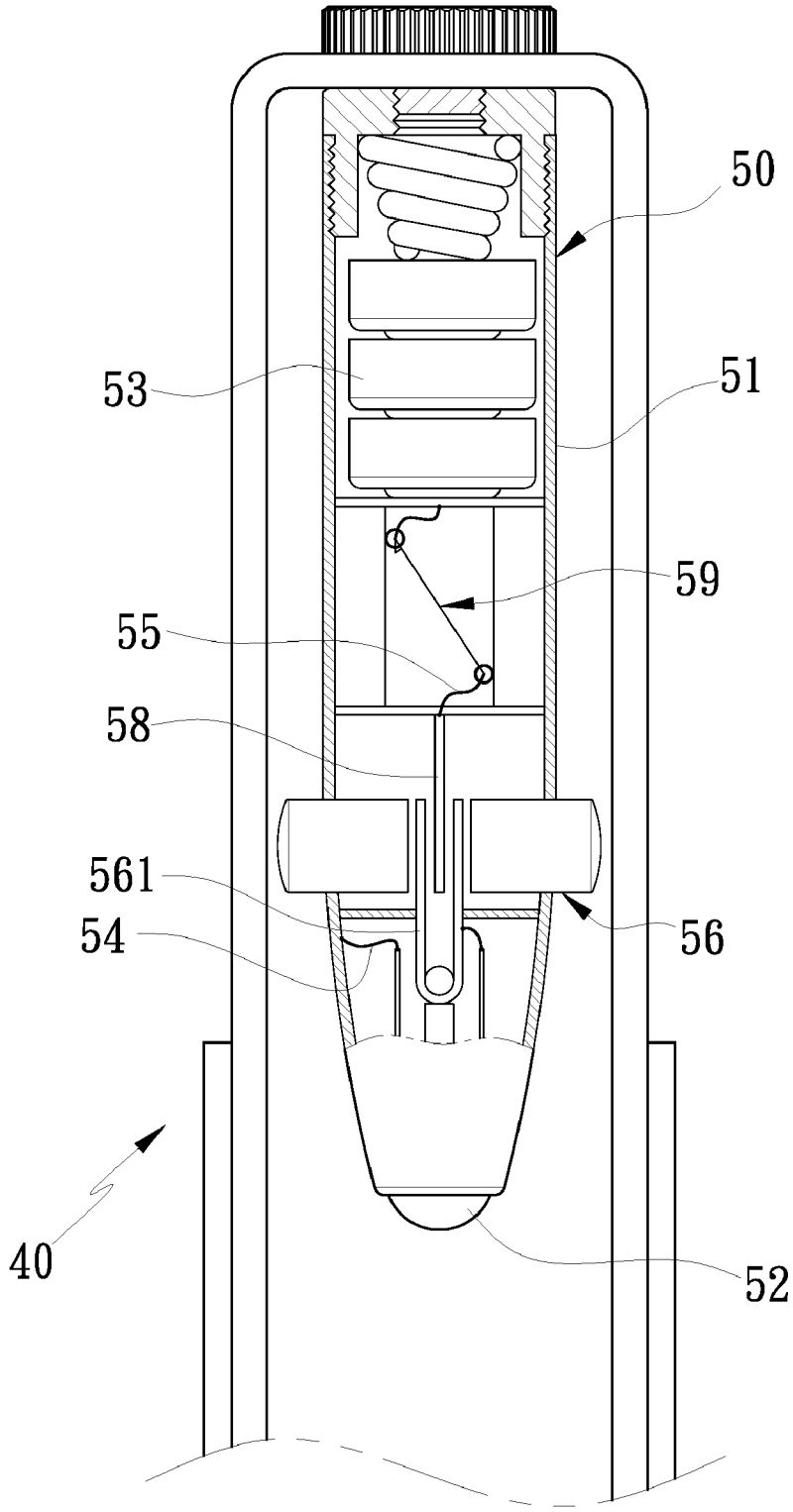
FIG. 10 is a cross sectional view showing a part of a clip with a light according to a second embodiment of the present invention.

As illustrated in FIG. 10, a clip with a light according to a second embodiment of the present invention comprises a body 40 and an illuminating device 50, both of which are identical to those of the first embodiment, and a difference between the first and the second embodiments includes a receiving cylinder 51 having a switch 59 series connected to a power circuit. In this embodiment, the switch 59 is series connected to a second power circuit 55, and includes one end electrically coupled to an electricity conducting member 58, and another end electrically connected to an electrode of a front end of a cell set 53 so that the switch 59 and an actuating member 56 control a light 52 to turn on and off.

Figure 11:
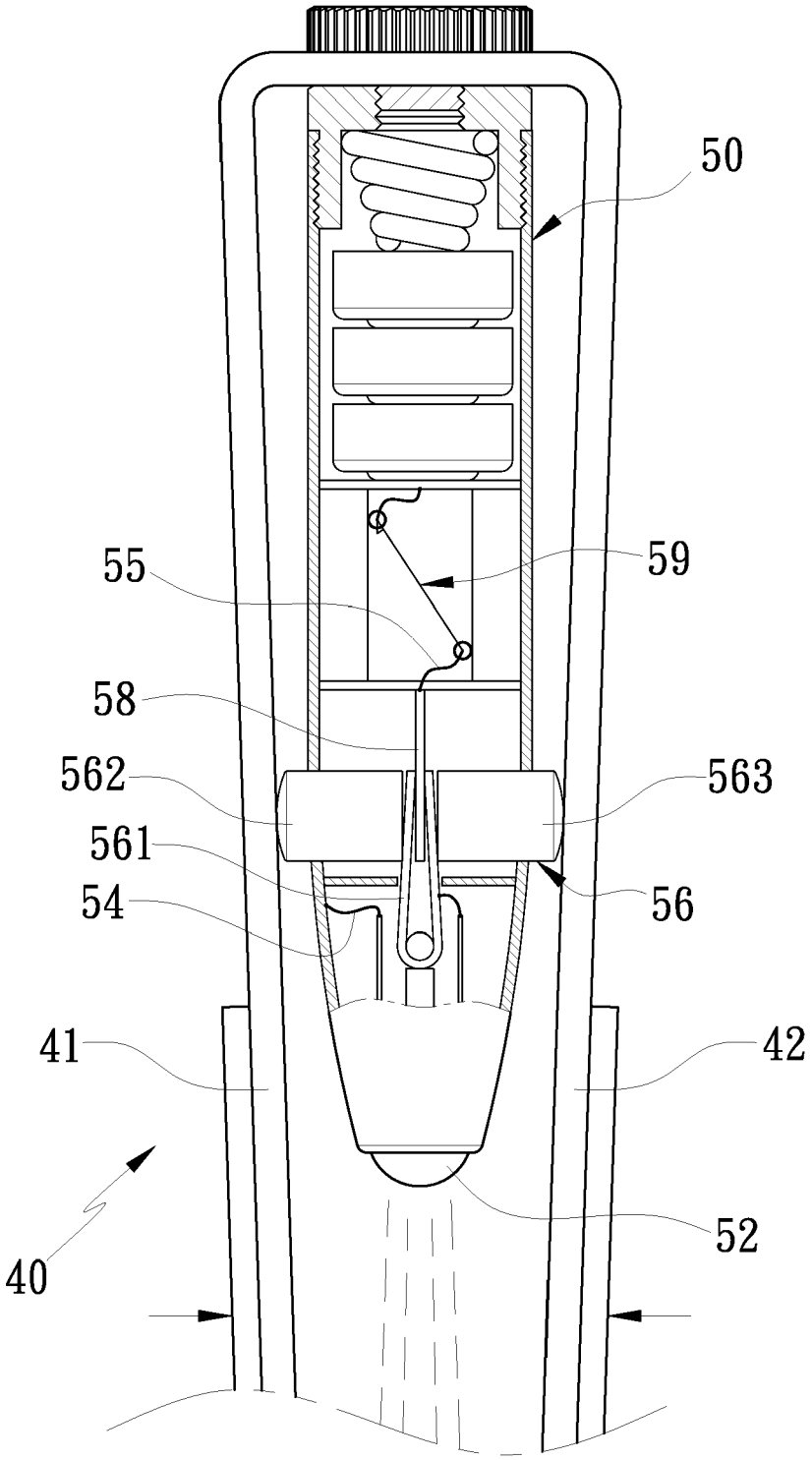
FIG. 11 is a cross sectional view showing the operation of the clip with the light according to the second embodiment of the present invention.

With reference to FIG. 11, when the switch 59 is switched to a first position, because the switch 59 remains in a conducting status, as a user presses a first and a second clip members 41, 42 to clip an object, the first and the second clip members 41, 42 abuts against pressing blocks 562, 563 of the actuating member 56 so that an U-shaped resilient piece 561 contacts with the electricity conducting member 58, and a first and the second power circuits 54, 55 generate a conducted circuit, turning on the light 52 automatically.

Figure 12:
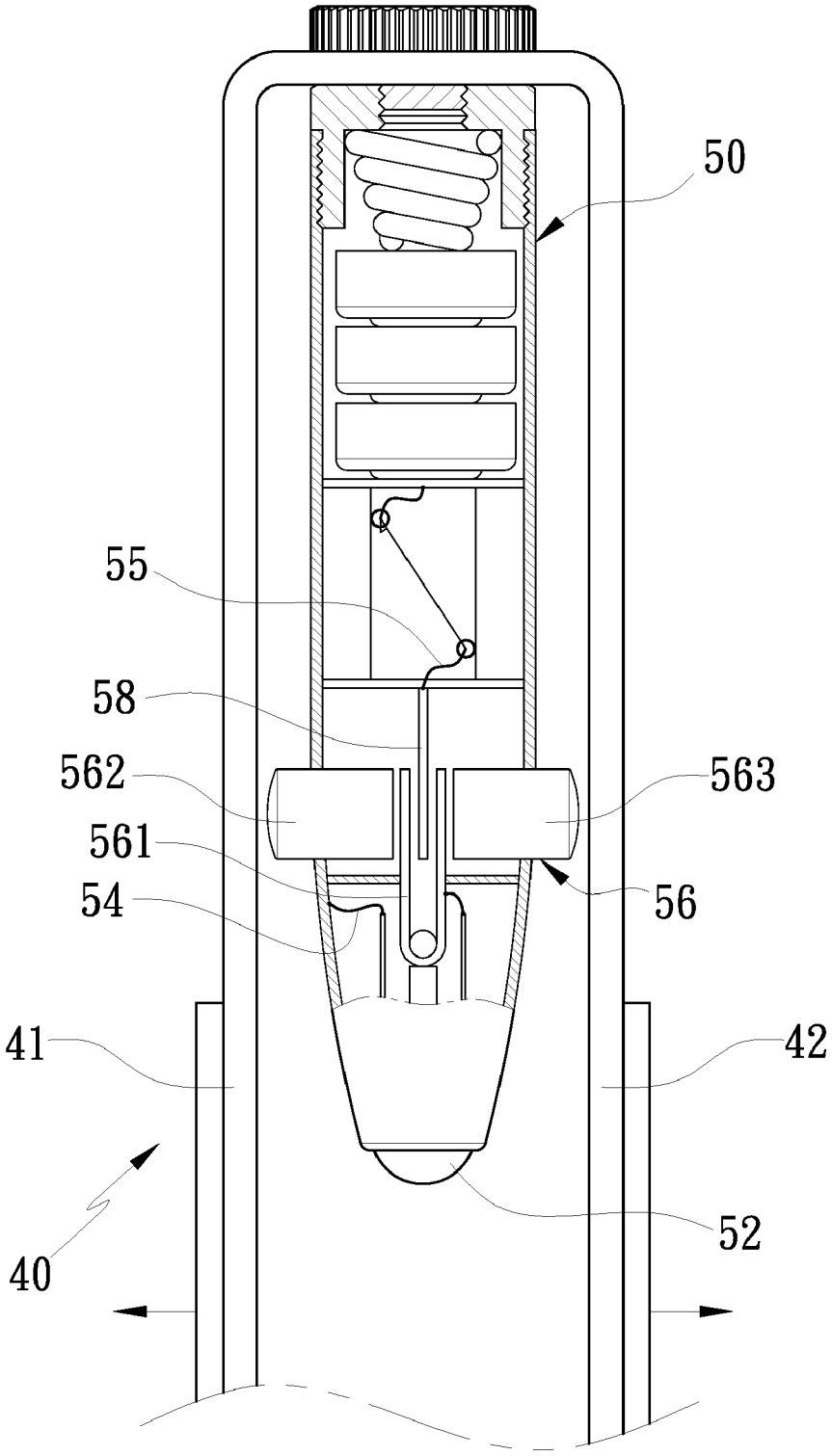
FIG. 12 is another cross sectional view showing the operation of the clip with the light according to the second embodiment of the present invention.

As shown in FIG. 12, when the user releases the first and the second clip members 41, 42, the first and the second clip members 41, 42 remove from the pressing blocks 562, 563 of the actuating member 56 so that the resilient piece 56 does not contact with the electricity conducting member 58, and the second power circuit 55 generate a circuit break to turn off the light 52 automatically.

Figure 13:
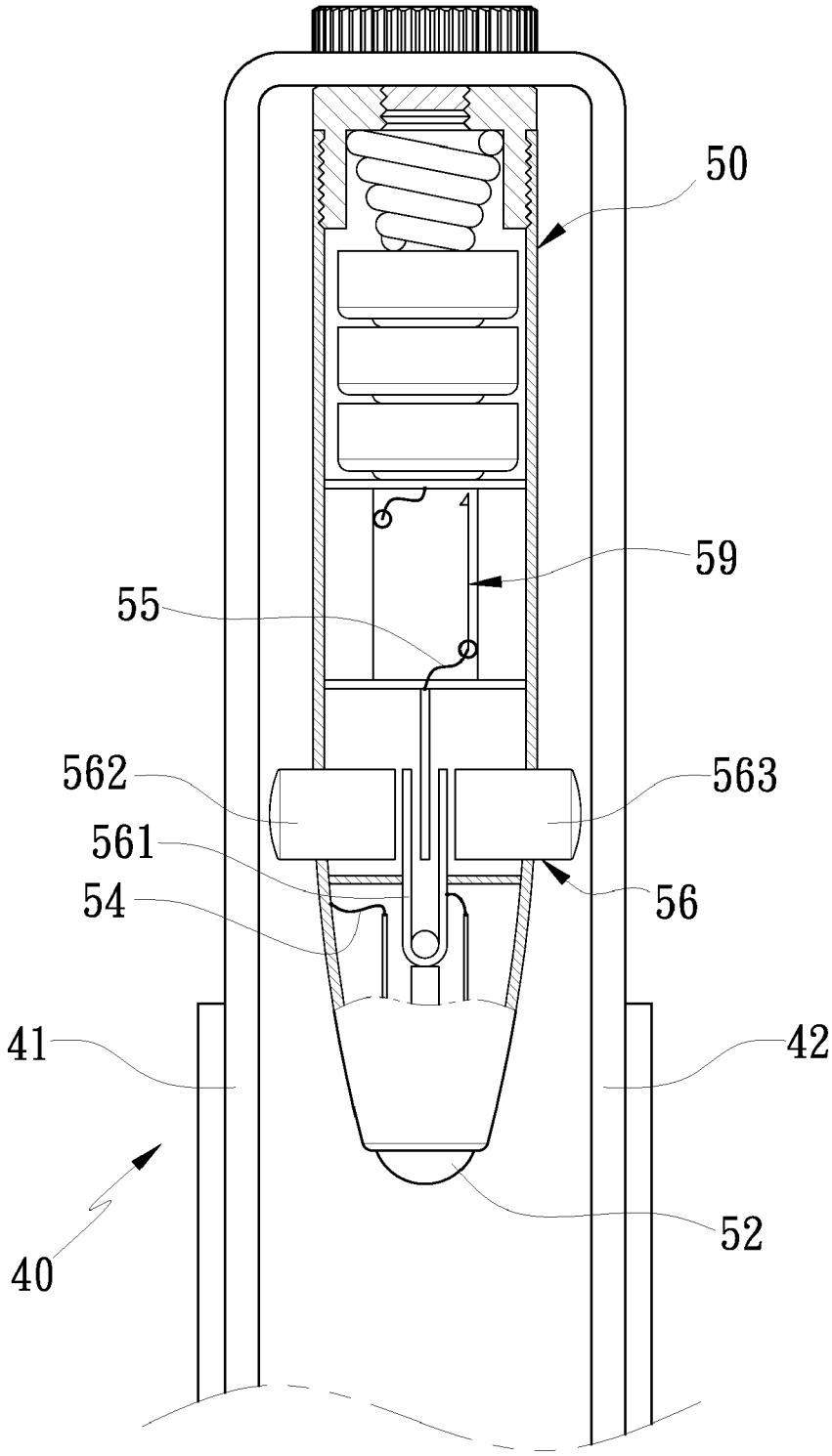
FIG. 13 is also another cross sectional view showing the operation of the clip with the light according to the second embodiment of the present invention.

Referring to FIG. 13, when the switch 59 is switched to a second position, because the switch 59 remains in a circuit breaking status, no matter the first and the second clip members 41, 42 are pressed, a break circuit is generated to turn off the light 52, thus operating the clip without illumination based on requirement.

Figure 14:
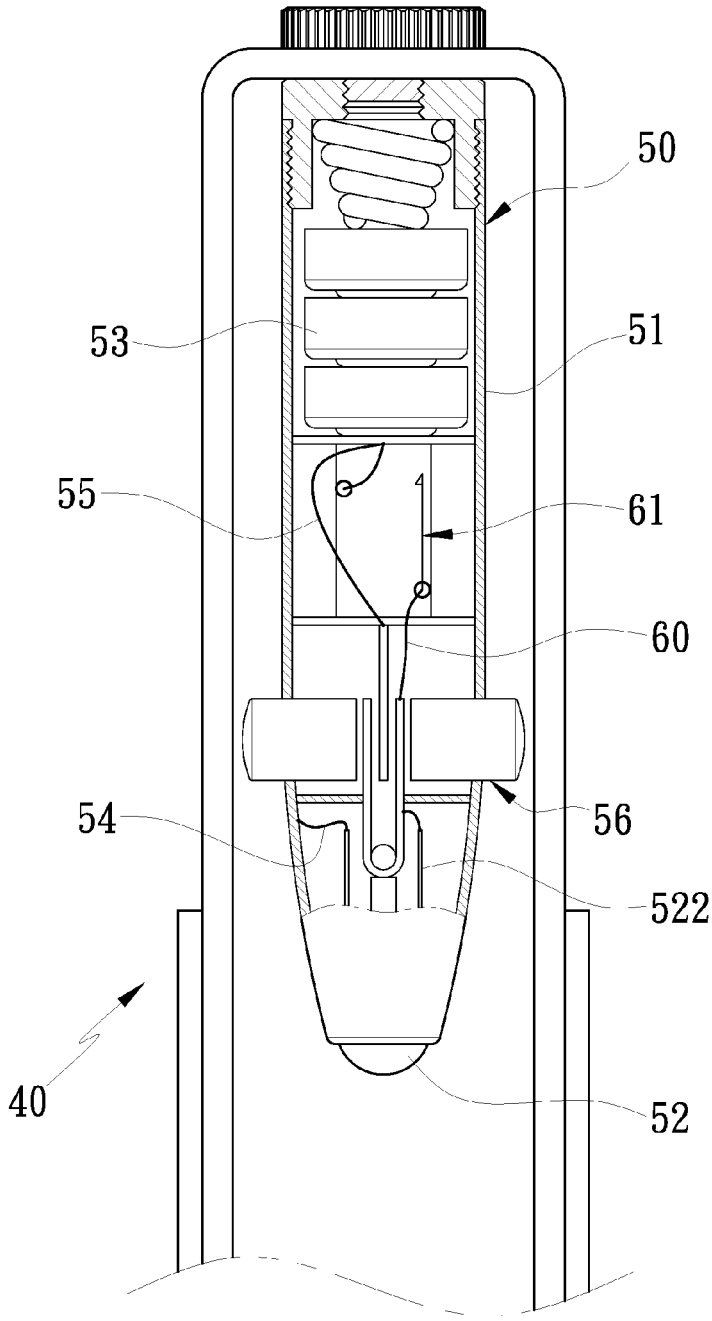
FIG. 14 is a cross sectional view showing a part of a clip with a light according to a third embodiment of the present invention.

As illustrated in FIG. 14, a clip with a light according to a third embodiment of the present invention comprises a body 40 and an illuminating device 50, both of which are identical to those of the first embodiment, and a difference between the first and the third embodiments includes a receiving cylinder 51 additionally provided with another power circuit. In this embodiment, the another power circuit is a third power circuit 60, wherein the third power circuit 60 includes one end electrically connected to a second connecting leg 522 of the light 52, and includes another end electrically coupled to an electrode of a front end of a cell set 53 to form another circuit with a first power circuit 54, and the third power circuit 60 is series connected to a switch 61 so that the switch 61 allows to control the third power circuit 60 in an electricity conducting or breaking status to turn on and off the light 52 with an actuating member 56.

Figure 15:
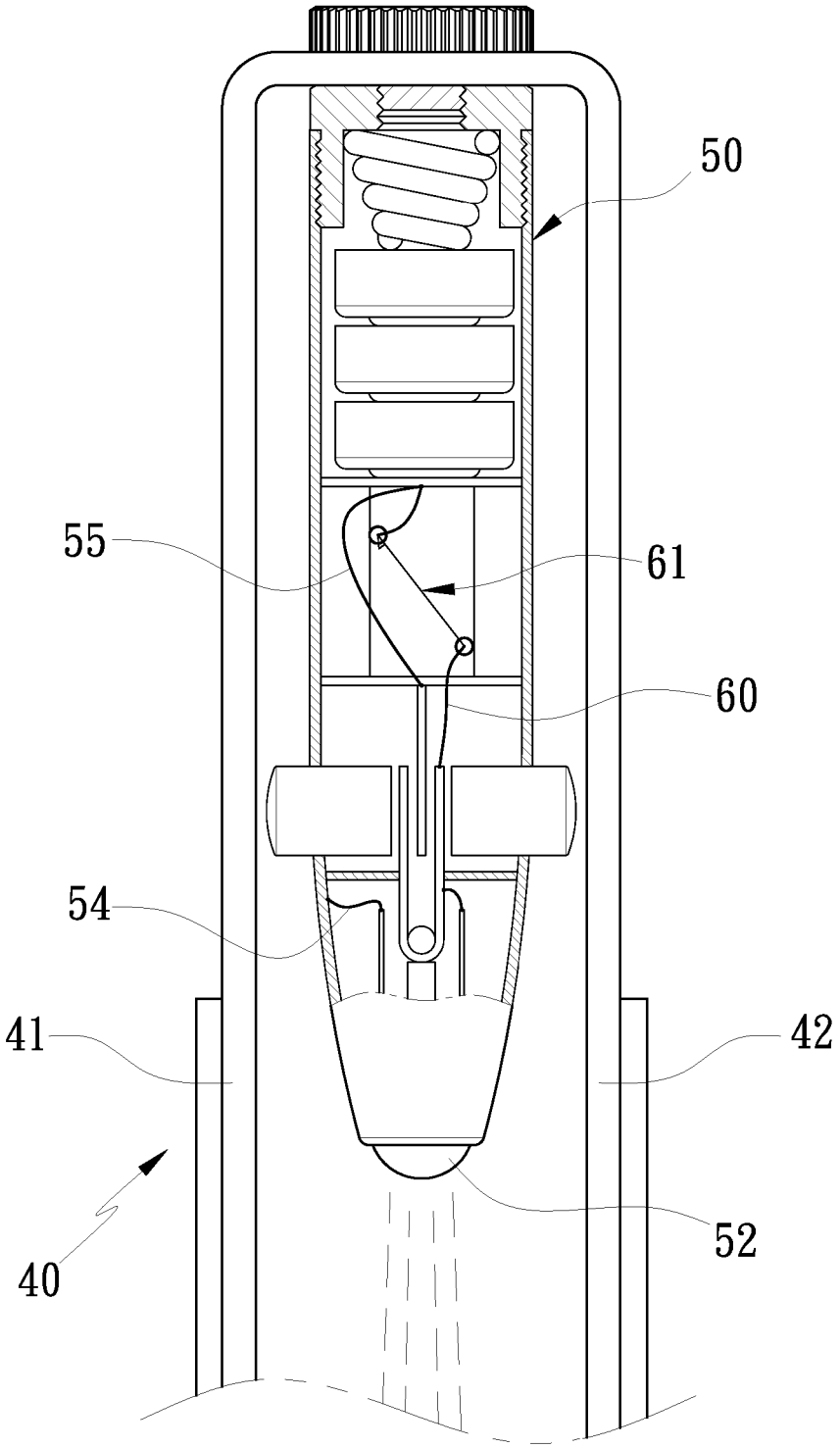
FIG. 15 is a cross sectional view showing the operation of the clip with the light according to the third embodiment of the present invention.

With reference to FIG. 15, when the switch 61 of the third power circuit 60 is switched to the first position, due to the switch 61 remains in an electricity conducting state, the first and the third power circuits 54, 60 generate a conducting circuit, no matter the first and the second clip members 41, 42 are pressed, the circuit is conducted to turn on the light 52, therefore the clip is operated without turning on the light.

Figure 16:
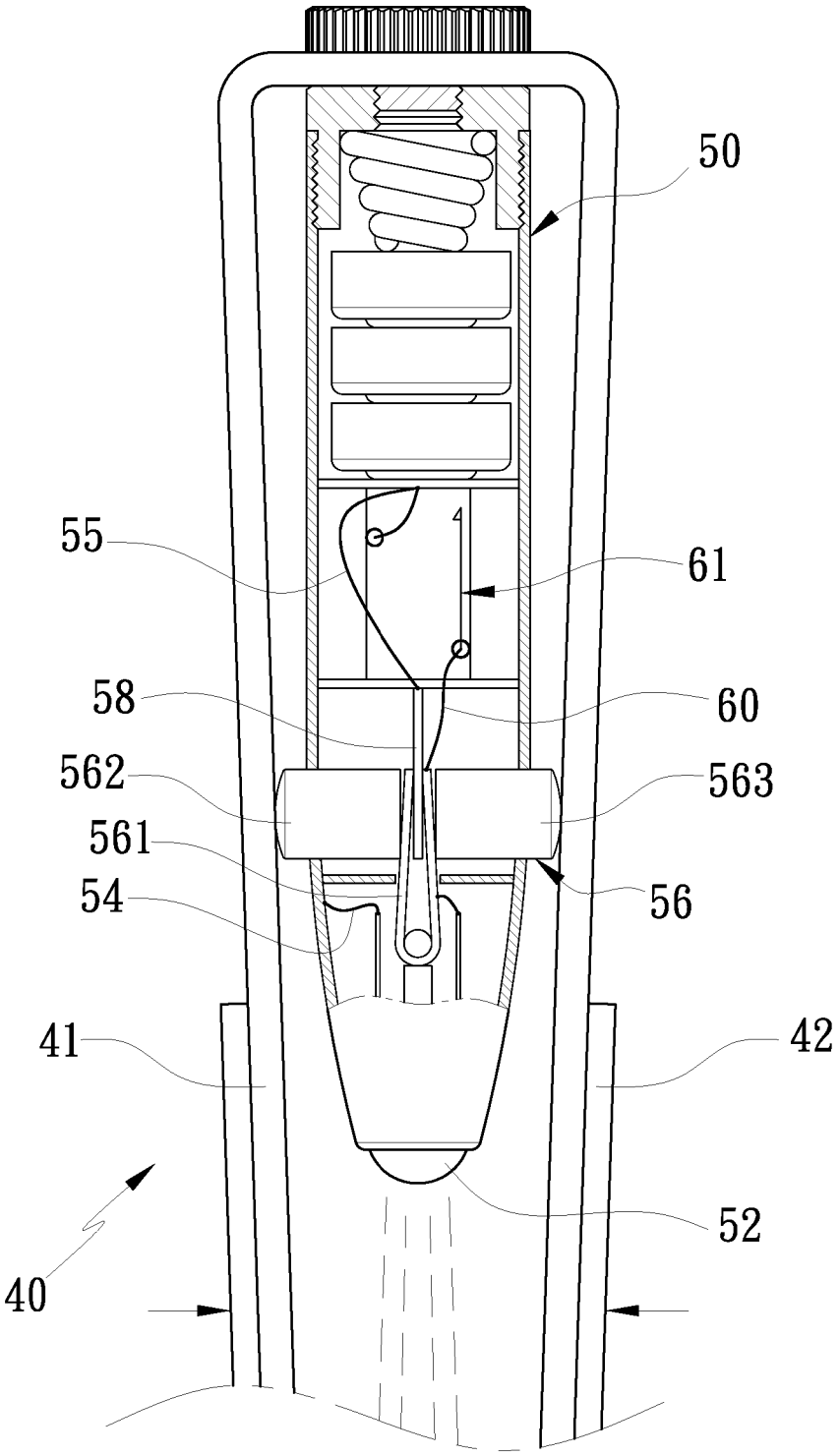
FIG. 16 is another cross sectional view showing the operation of the clip with the light according to the third embodiment of the present invention.

As shown in FIG. 16, as the switch 61 of the third power circuit 60 is switched to a third position, because the switch 61 remains in an electricity breaking state, the third power circuit 60 is in an electricity breaking status as well, and when a user presses the first and the second clip members 41, 42 to clip an object, the first and the second clip members 41, 42 push the pressing blocks 562, 563 of the switch 56 to move inward, and the resilient piece 561 contacts with the electricity conducting member 58 so that the first and the second power circuits 54, 55 generate a conducted circuit to turn on the light 52 automatically.

Figure 17:
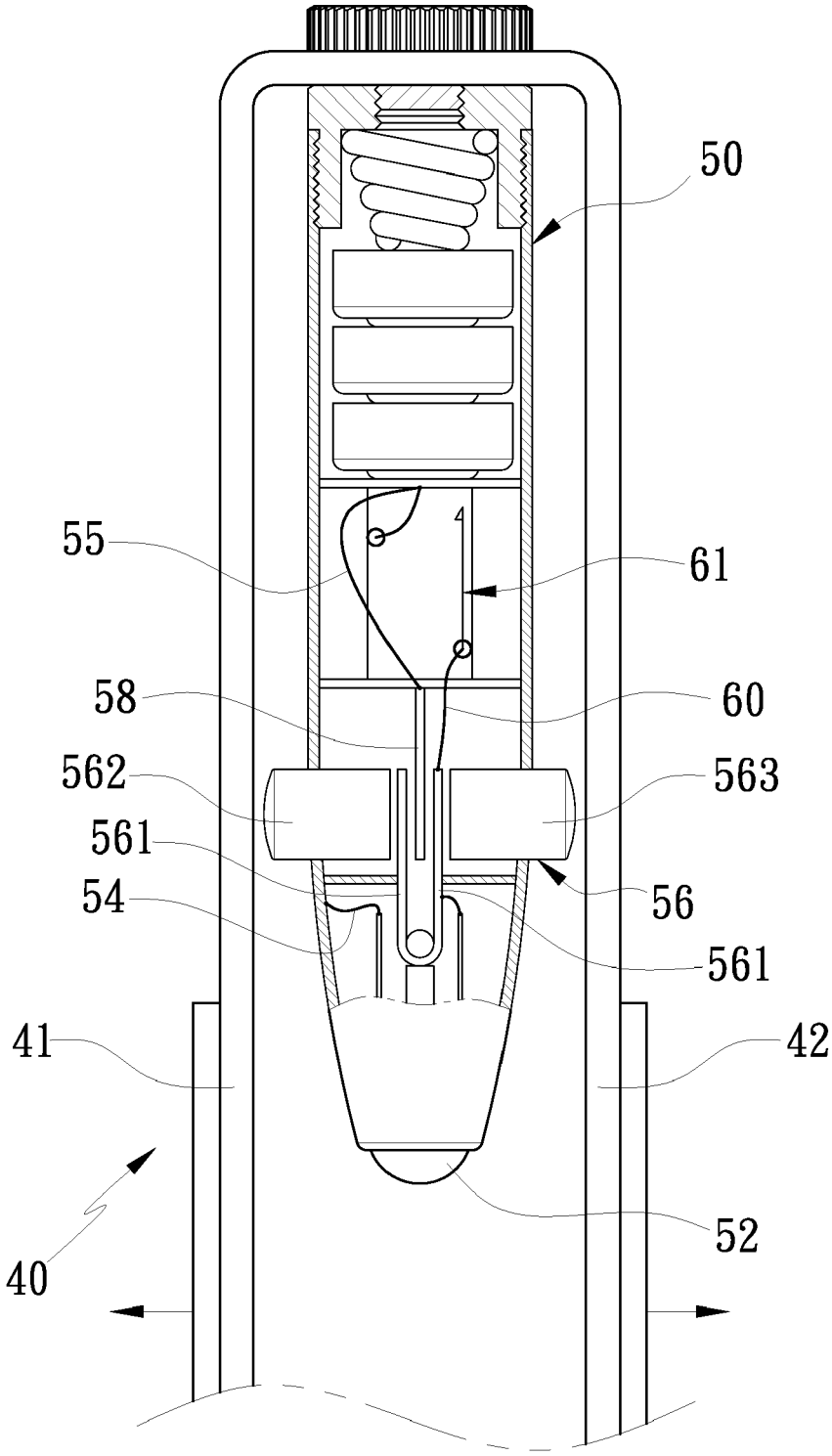
FIG. 17 is also another cross sectional view showing the operation of the clip with the light according to the third embodiment of the present invention.

As illustrated in FIG. 17, when the user releases the first and the second clip members 41, 42, the first and the second clip members 41, 42 remove from the pressing blocks 562, 563 of the actuating member 56 so that the resilient piece 561 does not contact with the electricity conducting member 58 to generate an electricity break, turning off the light 52 automatically.

While we have shown and described various embodiments in accordance with the present invention, it is clear to those skilled in the art that further embodiments may be made without departing from the scope of the present invention.

What is claimed is:

1. A clip with a light comprising a body and an illuminating device, the body including a first and a second clip members is flexibly pressed, and the illuminating device disposed between the first and the second clip members, and including:

a receiving cylinder;

a light received in the receiving cylinder and having a first and a second connecting legs;

a cell set received in the receiving cylinder to supply power to the light;

a power circuit unit mounted in the receiving cylinder and having an electrode of a rear end of the cell set electrically connected to the first connecting leg of the light, and the second connecting leg of the light electrically coupled to the electrode of a front end of the cell set;

an actuating member series connected onto the power circuit and having pressing blocks extending out of the receiving cylinder to correspond to the first and the second clip members and to press and release the first and the second clip members, so that the actuating member controls the light to turn on and off.

2. The clip with the light as claimed in claim 1, wherein between rear ends of the first and the second clip members is disposed a seat.

3. The clip with the light as claimed in claim 2, wherein the seat includes a hole disposed thereon to insert a screwing element so that the illuminating device is screwed with the screwing element is positioned between the first and the second clipping members.

4. The clip with the light as claimed in claim 1, wherein the receiving cylinder includes a cover screwed on a rear end thereof to abut against the electrode of the rear end of the cell set.

5. The clip with the light as claimed in claim 1, wherein the power circuit unit includes a first and a second power circuit, the first power circuit includes the electrode of the rear end of the cell set electrically connected to the first connecting leg of the light, and the second power circuit includes the second connecting leg of the light electrically coupled to the electrode of the front end of the cell set.

6. The clip with the light as claimed in claim 1, wherein the actuating member includes an electrically conductive U-shaped resilient piece to flexibly expand and retract, and the resilient piece includes pressing blocks disposed on two outer sides thereof to extend out of the receiving cylinder and correspond to the first and the second clip members respectively, and the receiving cylinder includes an electricity conducting member mounted therein in response to an inner wall of the resilient piece, and one end of the second power circuit is in connection with the electricity conducting member, another end of the second power circuit couples with the resilient piece so that the actuating member controls the light to turn on and off.

7. A clip with a light comprising a body and an illuminating device, the body including a first and a second clip members is flexibly pressed, and the illuminating device disposed between the first and the second clip members, and including:

a receiving cylinder;

a light received in the receiving cylinder and having a first and a second connecting legs;

a cell set received in the receiving cylinder to supply power to the light;

a power circuit unit mounted in the receiving cylinder and having an electrode of a rear end of the cell set electrically connected to the first connecting leg of the light, and the second connecting leg of the light electrically coupled to the electrode of a front end of the cell set;

an actuating member series connected onto the power circuit and having pressing blocks extending out of the receiving cylinder to correspond to the first and the second clip members and to press and release the first and the second clip members, so that the actuating member controls the light to turn on and off;

a switch series connected to the power circuit unit to conduct or break the power circuit.

8. The clip with the light as claimed in claim 7, wherein between rear ends of the first and the second clip members is disposed a seat.

9. The clip with the light as claimed in claim 7, wherein the seat includes a hole disposed thereon to insert a screwing element so that the illuminating device is screwed with the screwing element is positioned between the first and the second clipping members.

10. The clip with the light as claimed in claim 7, wherein the receiving cylinder includes a cover screwed on a rear end thereof to abut against the electrode of the rear end of the cell set.

11. The clip with the light as claimed in claim 7, wherein the power circuit unit includes a first and a second power circuit, the first power circuit includes the electrode of the rear end of the cell set electrically connected to the first connecting leg of the light, and the second power circuit includes the second connecting leg of the light electrically coupled to the electrode of the front end of the cell set.

12. The clip with the light as claimed in claim 7, wherein the actuating member includes an electrically conductive U-shaped resilient piece to flexibly expand and retract, and the resilient piece includes pressing blocks disposed on two outer sides thereof to extend out of the receiving cylinder and correspond to the first and the second clip members respectively, and the receiving cylinder includes an electricity conducting member mounted therein in response to an inner wall of the resilient piece, and one end of the second power circuit is in connection with the electricity conducting member, another end of the second power circuit couples with the resilient piece so that the actuating member controls the light to turn on and off.

13. The clip with the light as claimed in claim 7, wherein when the switch is switched to a first position, the switch is conducted so that the actuating member controls the light to be turned on and off, and when the switch is switched to a second position, the switch is broken so that the power circuit is broken to keep turning off the light.

14. A clip with a light comprising a body and an illuminating device, the body including a first and a second clip members is flexibly pressed, and the illuminating device disposed between the first and the second clip members, and including:

a receiving cylinder;

a light received in the receiving cylinder and having a first and a second connecting legs;

a cell set received in the receiving cylinder to supply power to the light;

a first power circuit mounted in the receiving cylinder and having an electrode of a rear end of the cell set electrically connected to the first connecting leg of the light;

a second power circuit mounted in the receiving cylinder and having the second connecting leg of the light electrically coupled to the electrode of a front end of the cell set to form a circuit with the first power circuit;

a third power circuit fixed in the receiving cylinder and includes the second connecting leg of the light electrically connected to the electrode of the front end of the cell set to generate another circuit with the first power circuit;

an actuating member series connected onto the power circuit and having pressing blocks extending out of the receiving cylinder to correspond to the first and the second clip members and to press and release the first and the second clip members, so that the actuating member controls the light to turn on and off;

a switch series connected to the third power circuit to conduct or break the third power circuit.

15. The clip with the light as claimed in claim 14, wherein between rear ends of the first and the second clip members is disposed a seat.

16. The clip with the light as claimed in claim 15, wherein the seat includes a hole disposed thereon to insert a screwing element so that the illuminating device is screwed with the screwing element is positioned between the first and the second clipping members.

17. The clip with the light as claimed in claim 14, wherein the receiving cylinder includes a cover screwed on a rear end thereof to abut against the electrode of the rear end of the cell set.

18. The clip with the light as claimed in claim 14, wherein the actuating member includes an electrically conductive U-shaped resilient piece to flexibly expand and retract, and the resilient piece includes pressing blocks disposed on two outer sides thereof to extend out of the receiving cylinder and correspond to the first and the second clip members respectively, and the receiving cylinder includes an electricity conducting member mounted therein in response to an inner wall of the resilient piece, and one end of the second power circuit is in connection with the electricity conducting member, another end of the second power circuit couples with the resilient piece so that the actuating member controls the light to turn on and off.

19. The clip with the light as claimed in claim 14, wherein when the switch is switched to a first position, the switch is conducted so that the actuating member controls the light to be turned on and off, and when the switch is switched to a second position, the switch is broken so that the power circuit is broken to keep turning off the light.

* * * * *